US007119778B2

(12) United States Patent
Yamashita et al.

(10) Patent No.: US 7,119,778 B2
(45) **Date of Patent: *Oct. 10, 2006**

(54) DISPLAY APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 234 days.

This patent is subject to a terminal disclaimer.

(21) Appl. No.: 10/271,436

(22) Filed: Oct. 15, 2002

(65) Prior Publication Data

US 2003/0151564 A1 Aug. 14, 2003

(30) Foreign Application Priority Data

Oct. 17, 2001 (JP) ..... P2001-319261

(51) Int. Cl.
*G09G 3/36* (2006.01)

(52) U.S. Cl. ..... 345/96; 345/99

(58) Field of Classification Search ..... 345/92, 345/96, 99

See application file for complete search history.

(56) References Cited

U.S. PATENT DOCUMENTS 5,426,447 A * 6/1995 Lee ..... 345/103
5,686,936 A * 11/1997 Maekawa et al. ..... 345/94
5,892,493 A * 4/1999 Enami et al. ..... 345/94
5,959,600 A * 9/1999 Uchino et al. ..... 345/94
6,157,358 A * 12/2000 Nakajima et al. ..... 345/96
6,266,039 B1 * 7/2001 Aoki ..... 345/94
6,356,253 B1 * 3/2002 Uchino et al. ..... 345/89
6,429,842 B1 * 8/2002 Shin et al. ..... 345/92
6,512,505 B1 * 1/2003 Uchino et al. ..... 345/96
6,731,266 B1 * 5/2004 Jung ..... 345/103
6,744,417 B1 * 6/2004 Yamashita et al. ..... 345/92
2002/0047820 A1 * 4/2002 Ha ..... 345/87

FOREIGN PATENT DOCUMENTS

JP 10-143113 5/1998
JP 2000-267067 9/2000

* cited by examiner

*Primary Examiner*—Kent Chang
(74) *Attorney, Agent, or Firm*—Sonnenschein Nath & Rosenthal LLP

(57) ABSTRACT

A display apparatus is disclosed which uses an improved precharge method and includes a reduced number of precharge switches. A pixel array section includes gate lines disposed in the direction of a row, signal lines disposed in the direction of a column, and pixels arranged in rows and columns at points at which the gate lines and the signal lines intersect with each other. A precharge switch is connected between a precharge line and each of the signal lines. A precharge drive circuit performs batch precharge wherein it drives the precharge switches at a time within a horizontal blanking period preceding to a horizontal scanning period to apply a precharge signal of a first level at a time to the signal lines and sequential precharge wherein it successively drives the precharge switches within the horizontal scanning period to successively apply a precharge signal of a second level to the signal lines.

4 Claims, 13 Drawing Sheets

WAVEFORM OF PSIG1

FIG. 9
PRIORART
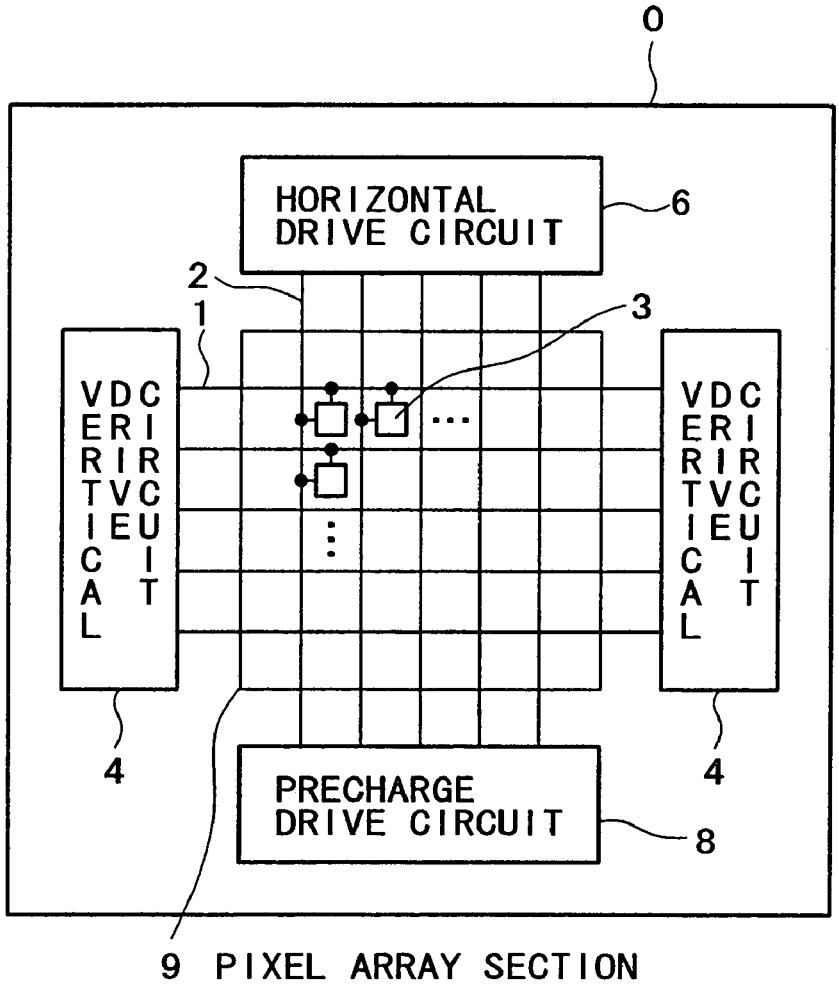

PRIOR ART

DISPLAY APPARATUS

RELATED APPLICATION DATA

The present invention claims priority to Japanese Application No. P2001-319261 filed Oct. 17, 2001, which application is incorporated herein by reference to the extent permitted by law.

BACKGROUND OF THE INVENTION

The present invention relates to an active matrix display apparatus of the dot sequentially driven type, and more particularly to a display apparatus of the type mentioned which adopts a technique of suppressing crosstalk between pixels and so forth to assure a high picture quality.

An active matrix display apparatus uses a 1H inversion driving method wherein, when it performs dot sequential driving, a video signal to be written into pixels is inverted for each one horizontal scanning period (1H). In the 1H inversion driving, if charging/discharging current upon writing of a video signal into a signal line provided for each column of pixels disposed in rows and columns in high, then a defect called "vertical stripe" appears on the display screen. To suppress the charging/discharging current upon writing of a video signal as low as possible, a precharge drive method wherein a precharge signal is written prior to writing of a video signal is adopted conventionally.

A vertical stripe of a medium gray level is most likely to appear among such vertical stripes. Accordingly, a gray level with which a vertical stripe is most likely to appear is normally set as a level for a precharge signal. However, if the potential for the precharge signal is set to a gray level, then when a window pattern or the like is displayed, crosstalk in a vertical direction (such crosstalk may be hereinafter referred to as vertical crosstalk) is sometimes caused by the fact that the light leak amount between the source and the drain of a pixel transistor locally differs, and deteriorates the picture quality.

To prevent occurrence of such vertical crosstalk, the precharge signal should be set to a black level. Where the precharge signal is set in this manner, the leak current between the source and the drain of a pixel transistor becomes uniform over the entire screen. However, if the precharge signal is set to a black level, then a vertical stripe described above becomes likely to appear conversely. In other words, the "vertical crosstalk" and the "vertical stripe" have a relationship of tradeoff to each other.

Taking the foregoing into consideration, a "dot sequential 2-step precharge method" wherein a black level and a gray level are precharged at two steps has been proposed and is disclosed, for example, in Japanese Patent Laid-Open No. 2000-267067. An example of an active matrix display apparatus which adopts the dot sequential 2-step precharge method is shown in FIG. 9. FIG. 9 shows a general configuration of the display apparatus. Referring to FIG. 9, the display apparatus 0 shown includes a pixel array section 9, a pair of vertical drive circuits 4, a horizontal drive circuit 6 and a precharge drive circuit 8. The pixel array section 9 includes gate lines 1 extending in the direction of a row, signal lines 2 extending in the direction of a column, and pixels 3 disposed in rows and columns at points at which the gate lines 1 and the signal lines 2 intersect with each other. The vertical drive circuits 4 are connected to the gate lines 1 and successively select the pixels 3 in the individual rows in a predetermined vertical scanning period. The horizontal drive circuit 6 is connected to the signal lines 2 and writes a video signal dot-sequentially into the pixels 3 of a selected row within a predetermined horizontal period. It is to be noted that, though not shown, the video signal is supplied through predetermine video signal lines. Also the precharge drive circuit 8 is connected to the signal lines 2 and writes precharge signals of a black level and a gray level into the pixels in accordance with a dot sequential 2-step precharge method.

FIG. 10 shows a particular example of a configuration of the precharge drive circuit shown in FIG. 9. Referring to FIG. 10, in the configuration example shown, the precharge drive circuit 8 includes a shift register formed from flip-flops S/R connected at multiple stages. The shift register operates in response to a precharge clock PCK supplied thereto from the outside and successively transfers a precharge start pulse PST supplied thereto from the outside similarly to output shift pulses A, B, C, . . . . Further, precharge lines 7 for supplying precharge signals are disposed between the precharge drive circuit 8 and the pixel array section positioned on the upper side of the precharge drive circuit 8. The precharge signals are supplied from the outside through the precharge lines 7. In the arrangement shown in FIG. 10, four such precharge lines 7 are provided. The two upper side ones of the precharge lines 7 supply precharge signals PSIG-Gray1 and PSIG-Gray2 of a gray level, respectively. The two lower side ones of the precharge lines 7 supply precharge signals PSIG-Black1 and PSIG-Black2 of a black level, respectively. Further, a precharge switch set is provided between the precharge lines 7 and the signal lines 2 of the pixel array section side. In the arrangement shown in FIG. 10, a precharge switch PSWG is provided for each of the signal lines 2 corresponding to the upper side two precharge lines 7. Meanwhile, a precharge switch PSWB is provided for each of the signal lines 2 corresponding to the lower side two precharge lines 7. The first precharge switch PSWG is connected to the first precharge line 7, and the second precharge switch PSWG is connected to the second precharge line. In this manner, the precharge switches PSWG are connected alternately to the first and second precharge lines 7. Similarly, also the precharge switches PSWB are connected alternately to the third and fourth precharge lines 7. The precharge switches PSWG are driven to be opened or closed simultaneously for each set including two precharge switches PSWG. Also the precharge switches PSWB are driven to be opened or closed simultaneously for each set including two precharge switches PSWB. Generally, by driving a plurality of precharge switches to be opened or closed simultaneously as a unit, the frequency of the precharge clock PCK can be suppressed. However, the precharge switches may alternatively be driven successively one by one.

The shift pulse A outputted from the first stage of the shift register which forms the precharge drive circuit 8 is used to drive the precharge switches PSWG of the first set and the precharge switches PSWB of the second set to be opened and closed. The shift pulse B outputted from the second stage of the shift register is used to drive the precharge switches PSWG of the second set and the precharge switches PSWB of the third set to be opened and closed. The shift pulse C outputted from the third stage of the shift register is used to drive the precharge switches PSWG of the third set and the precharge switches PSWB of the fourth set to be opened and closed. While the precharge drive circuit 8 successively drives the precharge switches to be opened or closed in this manner, if attention is paid to one of the signal lines 2, normally a precharge switch PSWB is driven to be opened or closed first, and then a precharge switch PSWG is driven to be opened or closed. In other words, the precharge drive circuit 8 is configured such that the precharge signals PSIG-Black1 and PSIG-Black2 of the black level are sampled on the signal lines first, and then the precharge signals PSIG-Gray1 and PSIG-Gray2 of the gray level are sampled on the same signal lines.

It is to be noted that each of the pixels 3 included in the pixel array section is formed, in the arrangement shown in FIG. 10, from a liquid crystal cell LC and a pixel transistor TFT. The gate electrode of the pixel transistor TFT is connected to the corresponding gate line 1, and the source electrode is connected to the corresponding signal line 2 while the drain electrode is connected to the pixel electrode of the corresponding liquid crystal cell LC. The other electrode of the liquid crystal cell LC is grounded to a counter-potential VCOM through a common line.

FIG. 11 is a waveform diagram illustrating operation of the precharge circuit shown in FIG. 10. As described above, the shift register of the precharge drive circuit 8 operates in response to the precharge clock PCK to transfer the precharge start pulse PST to successively output shift pulses A, B, C, . . . . The precharge switches PSWG of the first set are opened in response to the shift pulse A, and the precharge signals of the gray level are held by the corresponding signal lines. Simultaneously, also the precharge switches PSWB of the second set are opened, and the precharge signals of the black level are held by the preceding signal lines. In this manner, dot sequence precharge driving is performed in accordance with the two-step method wherein the precharge signals of the black level are sampled first and then the precharge signals of the gray level are sampled. Naturally, the dot sequence precharge driving is performed in prior to successive writing of video signals into the pixels 3. By sampling the precharge signals of the black level first, "vertical crosstalk" is suppressed, and then by sampling the precharge signals of the gray level, a "vertical stripe" can be suppressed.

FIG. 12 illustrates the waveforms of the precharge signals PSIG-Black1 and PSIG-Gray1 supplied to the precharge lines 7. The precharge signal PSIG-Black1 exhibits an inversion after each 1H with respect to the counter-potential VCOM, and the level PSIG-Black therefor is set to the black. In the example shown in FIG. 12, the counter-potential VCOM is 7.5 V, and the level PSIG-Black is 7.5±5.0 V. It is to be noted that also the other precharge signal PSIG-Black2 of the black level has a same waveform as that of the precharge signal PSIG-Black1. On the other hand, also the precharge signal PSIG-Gray1 exhibits an inversion after each 1H with respect to the counter-potential VCOM, and the potential level PSIG-Gray therefor is set to a gray level (7.5±2.5 V) of a half tone. This similarly applies also to the other precharge signal PSIG-Gray2.

In a display apparatus of an ordinary resolution, a distance of approximately 20 μm can be assured between signal lines. In this instance, one precharge switch PSWG and one precharge switch PSWB can be disposed corresponding to each of the signal lines 2 as seen in FIG. 10. Accordingly, in the conventional precharge drive circuit shown in FIG. 10, the precharge switches PSWG and the precharge switches PSWB can be disposed in an overlapping relationship with each other in two stages.

On the other hand, in a display apparatus for the high definition television system, the distance between signal lines is reduced to approximately 10 μm. In this instance, an area sufficient to allocate switches to signal lines in a one-by-one corresponding relationship is not assured. Therefore, the precharge switches are disposed in an upwardly and downwardly displaced relationship as seen in FIG. 13. More particularly, of the precharge switches PSWG for writing a gray level, the odd-numbered ones are disposed in the upper stage while the even-numbered ones are disposed in the lower stage. According to the arrangement just described, an area corresponding to two signal lines can be allocated to one precharge switch PSWG. However, different from the arrangement of FIG. 10, the precharge switches PSWG must be arranged not in one stage but in two upper and lower stages. Similarly, also the precharge switches PSWB for writing the black level are divided into two upper and lower stages. Accordingly, in a panel of a high definition, where the conventional 2-step dot sequential precharge driving method is applied, the precharge switches must be arranged in four upper and lower stages. In this manner, as the pixel pitch decreases as a result of increase of the definition of a panel and reduction of the panel size, the precharge switches PSW cannot be laid out within a pitch of one pixel any more. Therefore, the precharge switches PSW must be laid out in two overlapping stages in a pitch of 2 pixels as seen in FIG. 13. However, where the precharge switches PSWB and PSWG are placed individually in two overlapping stages, the precharge switches PSW are placed totally in four stages, and there is a problem that the space becomes insufficient and the precharge switches PSW cannot be laid out.

SUMMARY OF THE INVENTION

It is an object of the present invention to provide a display apparatus which uses an improved precharge method and can reduce the number of required precharge switches.

To attain the object described above, according to the present invention, there is provided a display apparatus, including a pixel array section including a plurality of gate lines extending in a direction of a row, a plurality of signal lines extending in a direction of a column, and a plurality of pixels arranged in rows and columns at points at which the gate lines and the signal lines intersect with each other, a vertical drive circuit connected to the gate lines for successively selecting the pixels for each row within a predetermined vertical scanning period, a video line for supplying a video signal, a sampling switch connected between the video line and each of the signal lines, a horizontal drive circuit for successively driving the sampling switches within a predetermined horizontal scanning period to write the video signal dot-sequentially into the pixels of the selected row, a precharge line for supplying a precharge signal, a precharge switch connected between the precharge line and each of the signal lines, and a precharge drive circuit for performing batch precharge wherein the precharge drive circuit drives the precharge switches at a time within a horizontal blanking period preceding to the horizontal scanning period to apply a precharge signal of a first level at a time to the signal lines and sequential precharge wherein the precharge drive circuit successively drives the precharge switches within the horizontal scanning period to successively apply a precharge signal of a second level to the signal lines.

Preferably, the precharge drive circuit applies a precharge signal of a black level in the batch precharge and applies a precharge signal of a gray level in the sequential precharge. In this instance, the precharge drive circuit applies, in the batch precharge, a precharge signal having a polarity same as that of the video signal written in the pixels in the preceding row. It is to be noted that the polarity of the precharge black upon the batch precharge need not necessarily be the same as that of the video signal written in the pixels in the preceding row. However, since the batch precharge is performed within a very short period within a horizontal blanking period, the precharge signal preferably has a polarity same as that of the preceding stage pixel potential to allow writing of the precharge black to be performed with certainty. The gate lines of the pixel array section may be wired in a unit of two rows spaced by a distance corresponding to an odd number of rows between adjacent ones of the pixel columns, and the horizontal drive circuit may successively write, into each two pixels which are connected to the same gate line and positioned adjacent each other, video signals of the opposite polarities through each of the signal lines whereas the precharge drive circuit performs the batch precharge prior to the writing of the video signals. The horizontal drive circuit may write a video signal, which has a polarity which is inverted after each horizontal scanning period, into each of the pixels.

In an active matrix type display apparatus of the 2-step dot sequential precharge driving method, as the pixel pitch decreases as a result of increase of the definition of a panel and reduction of the panel size, it becomes difficult to lay out precharge switches. Therefore, in the present invention, within a horizontal blanking period, batch precharge is performed to apply a precharge signal of, for example, a black level, and then in succeeding dot sequential precharge, a precharge signal of a gray level is applied. For the batch precharge, it is not necessary to provide precharge switches separately or additionally, but only it is required to provide switches for the 1-step sequential precharge. Accordingly, the number of switches for precharge can be reduced to one half that in the conventional display apparatus. Consequently, the layout area around the precharge drive circuit can be reduced to one half, and therefore, also on a panel of a small pixel pitch, such precharge switches can be laid out.

In summary, according to the present invention, since the batch+1-step dot sequential precharge driving is adopted, the number of switches for precharge around the precharge drive circuit can be reduced to one half that of a conventional display apparatus which adopts the 2-step precharge driving. Consequently, the display apparatus of the present invention can cope with reduction of the pixel pitch by an increase of the definition. Further, the display apparatus of the present invention is ready for both of the 1H inversion driving and the dot line inversion driving. Particularly, the batch+1-step dot sequential precharge driving according to the present invention is simultaneously effective to remove a "horizontal tailing" unique to the dot line inversion driving.

The above and other objects, features and advantages of the present invention will become apparent from the following description and the appended claims, taken in conjunction with the accompanying drawings in which like parts or elements denoted by like reference symbols.

BRIEF DESCRIPTION OF THE DRAWINGS

FIG. 9 is a schematic plan view showing an example of a conventional display apparatus;

DETAILED DESCRIPTION OF THE PREFERRED EMBODIMENT

Figure 1:
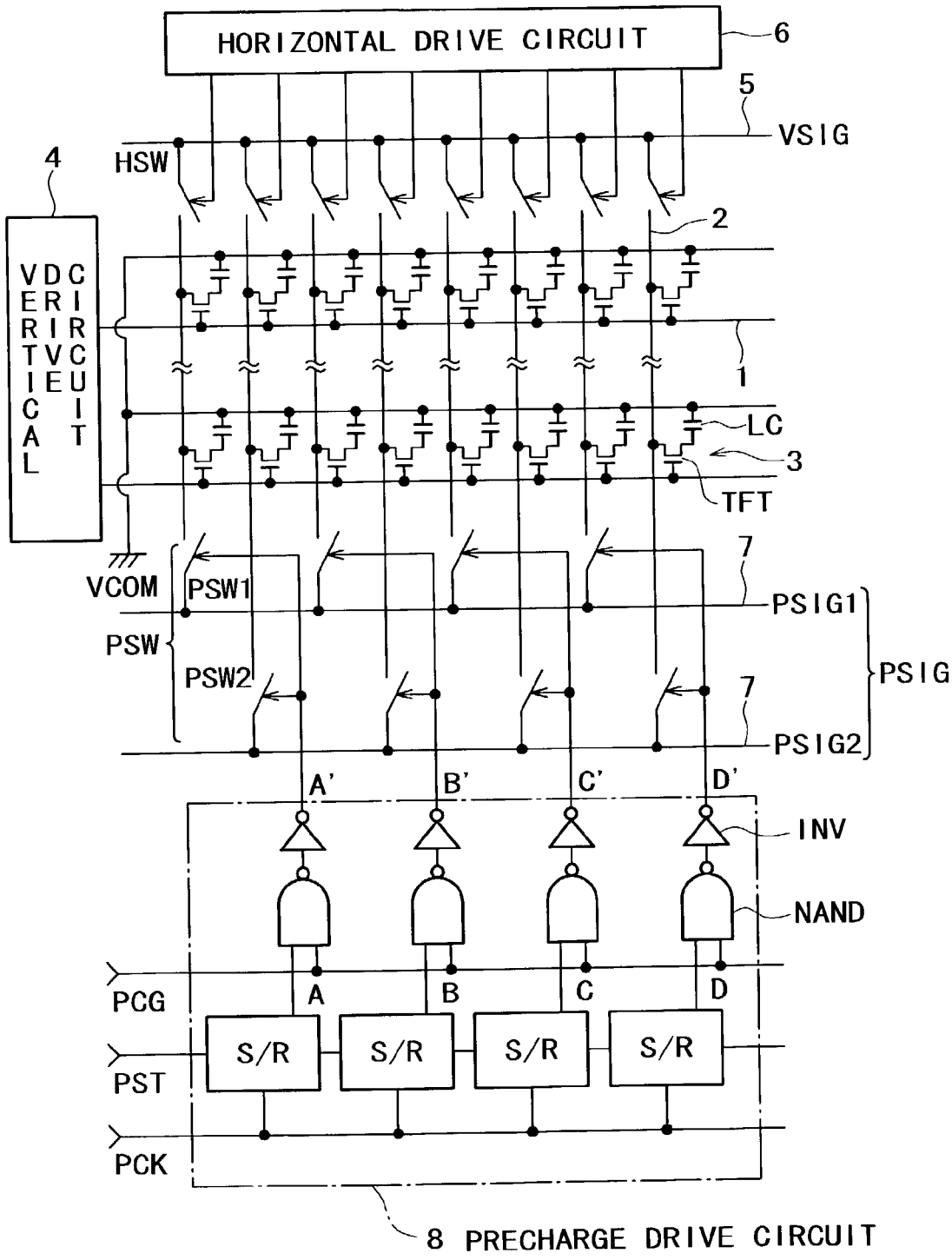
FIG. 1 is a circuit diagram showing a basic configuration of a display apparatus to which the present invention is applied.

Referring to FIG. 1, there is shown a display apparatus to which the present invention is applied. The display apparatus shown includes, as basic components thereof, a pixel array section, a vertical drive circuit 4, a video line 5, sampling switches HSW, a horizontal drive circuit 6, two precharge lines 7, precharge switches PSW and a precharge drive circuit 8. The pixel array section includes gate lines 1 extending in the direction of a row, signal lines 2 extending in the direction of a column, and pixels 3 arranged in rows and columns at points at which the gate lines 1 and the signal lines 2 intersect with each other. In the present embodiment, each of the pixels 3 is formed from a pixel transistor TFT and a liquid crystal cell LC. The gate electrode of the pixel transistor TFT is connected to a corresponding gate line 1, and the source electrode is connected to a corresponding signal line 2 while the drain electrode is connected to the pixel electrode of the liquid crystal cell LC. The other electrode of the liquid crystal cell LC is grounded to a counter-potential VCOM over through a common line. The vertical drive circuit 4 is connected to the gate lines 1 and successively selects the pixels 3 in the individual rows within a predetermined vertical scanning period. The video line 5 supplies a video signal VSIG inputted thereto from the outside to the pixel array section. Each of the sampling switches HSW is connected between the video line 5 and one of the signal lines 2. To facilitate understanding, the sampling switches HSW are drive dot-sequentially by the horizontal drive circuit 6. However, according to the present invention, driving of the sampling switches HSW is not limited to this. In other words, a plurality of sampling switches HSW may be driven collectively at a time to reduce the operating frequency of the horizontal drive circuit 6. The horizontal drive circuit 6 successively drives the sampling switches HSW within a predetermined horizontal scanning period (1H) so that the video signal VSIG is written dot-sequentially into the pixels 3 of the successively selected rows.

The two precharge lines 7 mentioned above supply precharge signals PSIG1 and PSIG2 inputted thereto from the outside to the pixel array section. While, in the present embodiment, two precharge lines 7 are disposed to precharge two signal lines at a time, the present invention is not limited to this. The precharge switches are connected between the precharge lines 7 and the signal lines 2. In the present embodiment, since the distance between the signal lines 2 is comparatively small, the precharge switches are divided into two upper and lower stages. The odd-numbered precharge switches PSW1 are disposed in the upper stage and each connected to one of the precharge lines 7. The even-numbered precharge switches PSW2 are disposed in the lower stage and connected to the other precharge line 7. It is to be noted that naturally the sampling switches HSW can be disposed in two stages.

The precharge drive circuit 8 performs batch precharge and sequential precharge at two separate steps. In the batch precharge, the precharge switches PSW are driven at a time within a horizontal blanking period preceding to a horizontal scanning period to apply a precharge signal of a first level at a time to the signal lines 2. Where, for example, a black level is applied as the first level, "vertical crosstalk" can be suppressed. Thereafter, sequential precharge is performed within the succeeding horizontal scanning period to successively drive the precharge switches PSW to apply a precharge signal of a second level sequentially to the signal lines 2. Where a precharge signal having, for example, a gray level is applied as the second level, a "vertical stripe" can be suppressed. It is to be noted that the precharge drive circuit 8 preferably applies a precharge signal PSIG of the same polarity as that of the video signal VSIG written in the pixels in the preceding row by the batch precharge described above. As a result, precharge of the black level can be performed efficiently.

The precharge drive circuit 8 has a basic configuration of a shift register wherein flip-flops S/R are connected at multiple stages. The shift register operates in response to a precharge clock PCK to transfer a precharge start pulse PST to successively output shift pulses A, B, C, D, . . . from the successive stages of the shift register. A NAND element and an inverter (INV) are connected in series to each of the stages of the shift register. Each of the NAND elements is connected at one of input terminals thereof to receive a shift pulse outputted from a corresponding one of the shift register stages and connected at the other input terminal thereof to receive a clock PCG for batch precharge. The inverters INV are connected to the output terminals of the NAND elements and individually output drive pulses A', B', C', D', . . . for driving the precharge switches PSW to open or close.

Figure 2:
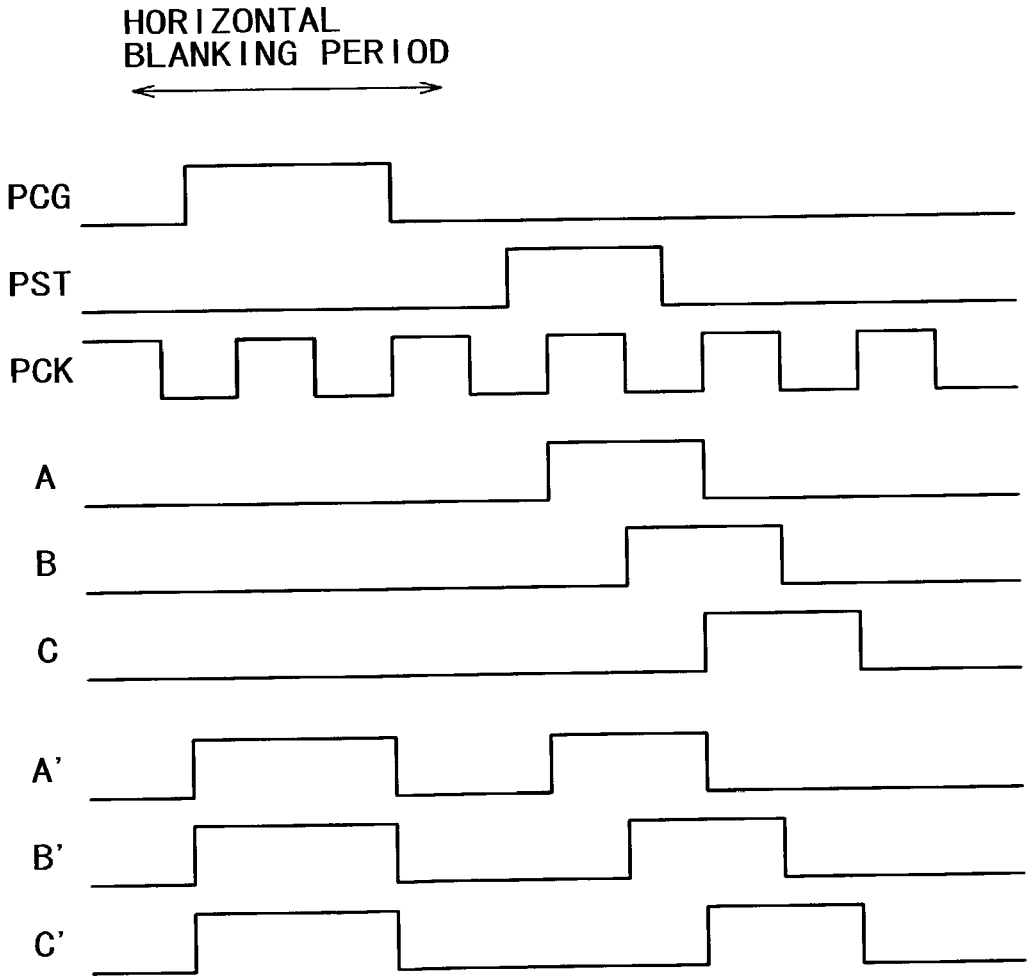
FIG. 2 is a timing chart illustrating operation of the display apparatus shown in FIG. 1.

FIG. 2 illustrates a precharging operation of the display apparatus shown in FIG. 1. As seen from FIG. 2, the clock PCG for batch precharge is inputted from the outside within a horizontal blanking period. Then, when a succeeding horizontal scanning period is entered, the precharge start pulse PST is inputted from the outside similarly. The precharge start pulse PST is successively transferred in the shift register in response to the precharge clock PCK, and thereupon, shift pulses A, B and C are outputted from the stages of the shift register. The clock PCG and the shift pulses are NANDed by the NAND elements and inverted by the inverters INV, and consequently, the shift pulses are outputted as drive pulses A', B' and C'. As seen from FIG. 2, the drive pulses A', B' and C' open the precharge switches PSW at a time within the horizontal blanking period. Consequently, the batch precharge in the first step is executed. Thereafter, the drive pulses A', B' and C' successively drive the precharge switches PSW to open and close. Consequently, the sequential precharge in the second step is performed. It is to be noted that the sequential precharge is performed in prior to dot sequential writing of a video signal into the pixels in a unit of a pixel.

Figure 3:
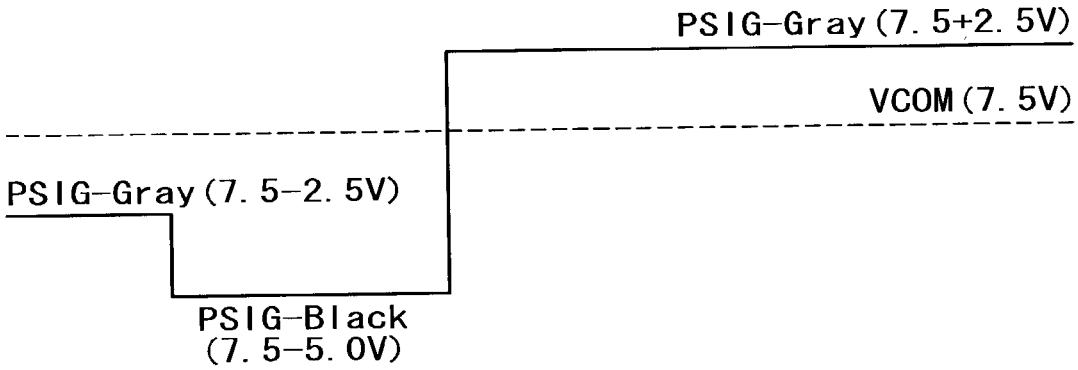
FIG. 3 is a waveform diagram illustrating operation of the display apparatus shown in FIG. 1.

FIG. 3 shows a waveform of the precharge signal PSTG1 supplied to one of the precharge lines 7. The precharge signal PSIG1 exhibits an inversion with respect to a counter-potential VCOM in a period of 1H. Basically, the precharge signal PSIG1 keeps a gray level PSIG-Gray (7.5±2.5 V) within a horizontal scanning period. However, the precharge signal PSIG1 has a black level PSIG-Black (7.5±5.0 V) within a horizontal blanking period. The black level PSIG-Black has a polarity same as that of the gray level PSIG-Gray in the preceding horizontal period. As can be seen from a contrast between FIGS. 2 and 3, a precharge signal of the black level is precharged in the batch precharge of the first step, and another precharge signal of the gray level is precharged in the sequential precharge of the second step.

In the batch/sequential precharge driving according to the present invention, the clock PCG is applied within a horizontal blanking period. The clock PCG is NANDed with the outputs of the shift register to produce precharge switch drive pulses. The clock PCG is used for black precharge and the shift register output pulses are used for gray precharge. Since the clock PCG is NANDed with all of the output stages of the shift register, the precharge switches PSW at all stages open at a time in response to the clock PCG.

In the present method, the precharge signal PSIG is set to the black level within the period of the clock pulse PCG but is set to the gray level within any other period. Consequently, a precharge signal of the black level can be written into all of the signal lines with the clock pulse PCG, thereby suppressing the "vertical crosstalk". At the time, to write the precharge signal of the black level sufficiently into the signal lines within a short horizontal blanking period, the polarity of the precharge signal of the black level is selected to the polarity same as that of the potential of the video signal written in the pixels in the preceding stage.

Further, a precharge signal of the gray level is successively written into the signal lines by the sequential precharge to take a countermeasure for a "vertical stripe". Since the precharge signal PSIG is used for both of the black precharge and the gray precharge in this manner, the number of precharge switches PSW per one pixel can be reduced from two (PSWB and PSWG) in the conventional display apparatus to one (PSW). By using the batch/successive precharge in this manner, the layout area for the precharge switches PSW is reduced to one half that in the conventional display apparatus, and layout suitable for a small pixel pitch can be achieved.

Incidentally, in an active matrix display apparatus wherein pixels are arrange in rows and columns, a dot sequential driving method wherein the pixels are successively driven in a unit of a pixel for each one line (one row) is normally used as the driving method. The dot sequential driving method includes a 1H inversion driving method and a dot inversion driving method.

In the 1H inversion driving method, when a video signal is written, since resistance is present between left and right pixels in the common line for supplying a predetermined dc voltage as the counter-potential VCOM to the pixels and besides parasitic capacitance is present between the common line and the signal lines, the video signal leaks into the common line or the gate lines to fluctuate the potential of the common line in a direction of a polarity same as the polarity of the video signal. Consequently, crosstalk in the horizontal direction (horizontal crosstalk) appears significantly or a shading defect appears, resulting in significant deterioration of the picture quality.

Further, while a pixel holds pixel information for a period of one field, the potential of the signal line fluctuates for each 1H. Here, in the case of the 1H inversion driving method, since the polarities of the video signals written in left and right adjacent pixels are same, the fluctuation of the potential of the signal line is great. Then, since the fluctuation of the potential leaks into the pixel through the source/drain coupling of the pixel transistor, "vertical crosstalk" appears significantly, which makes a factor of deterioration of the picture quality.

Meanwhile, in the dot inversion driving method, since video signals of the opposite polarities are written at a time into left and right adjacent pixels, the fluctuation of the potential of the common line or the signal lines is canceled between adjacent pixels, and therefore, the problem of deterioration of the picture quality in the 1H inversion driving system can be eliminated. On the contrary, however, since the polarities of video signals written in left and right adjacent pixels are different from each other, each pixel is influenced by electric fields of adjacent pixels, and consequently, a domain (light missing region) appears at a corner of an aperture of the pixel. As a result, the numerical aperture of the pixel decreases and drops the transmission factor, which gives rise to a drop of the contrast.

Figure 4:
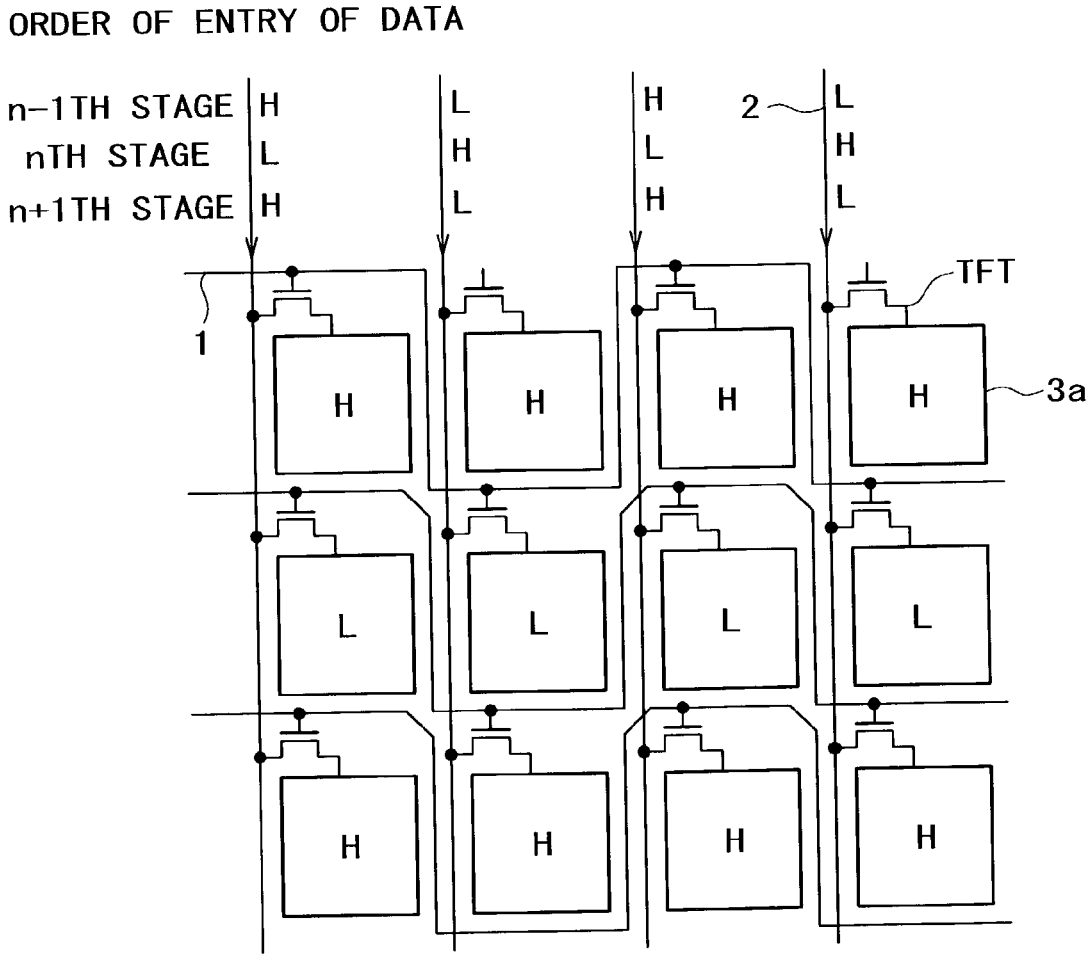
FIG. 4 is a diagrammatic view illustrating a dot line driving method.

Thus, a driving method has been proposed wherein video signals of the opposite polarities are written at a time into pixels in two rows spaced by a distance corresponding to an odd number of rows, for example, in two adjacent upper and lower rows between adjacent pixel columns such that, in the pixel array after video signals are written into the pixels, left and right adjacent pixels have the same polarity and upper and lower adjacent pixels have the opposite polarities. In the following description, the driving method just described is referred to as dot line inversion driving method. The dot line inversion driving method is schematically illustrated in FIG. 4. As apparently seen from FIG. 4, each gate line 1 extends in a meandering fashion along two rows. If attention is paid to the first gate line 1, the first pixel in the first row (first stage from above) and the second pixel in the second row (second stage from above) are allocated to the same gate line 1. In this manner, considering two rows of pixels as a unit, the pixels are allocated alternately between odd-numbered and even-numbered ones. Meanwhile, from each signal line, video signals having the opposite polarities (high and low) are written into each adjacent ones of the pixels. The video signal supplied to each signal line has the polarity which is inverted between H and L for each 1H. According to such a dot line inversion driving method as just described, a video signal of the H level is written into the pixels of the first row, and another video signal of the L level is written into the pixels of the second row. In this manner, H and L video signals can be written alternatively in the pixel stages. Meanwhile, from each signal line, video signals having the opposite polarities to each other are supplied to the pixels.

In the dot line inversion driving method, video signals of the opposite polarities are applied to each adjacent ones of the signal lines similarly as in the dot inversion driving method, and in the pixel array after such video signals are written, each left and right adjacent pixels have the same polarity similarly as in the 1H inversion driving method. Therefore, such factors of deterioration of the picture quality as horizontal crosstalk or shading can be reduced without decreasing the numerical aperture of each pixel.

Figure 5:
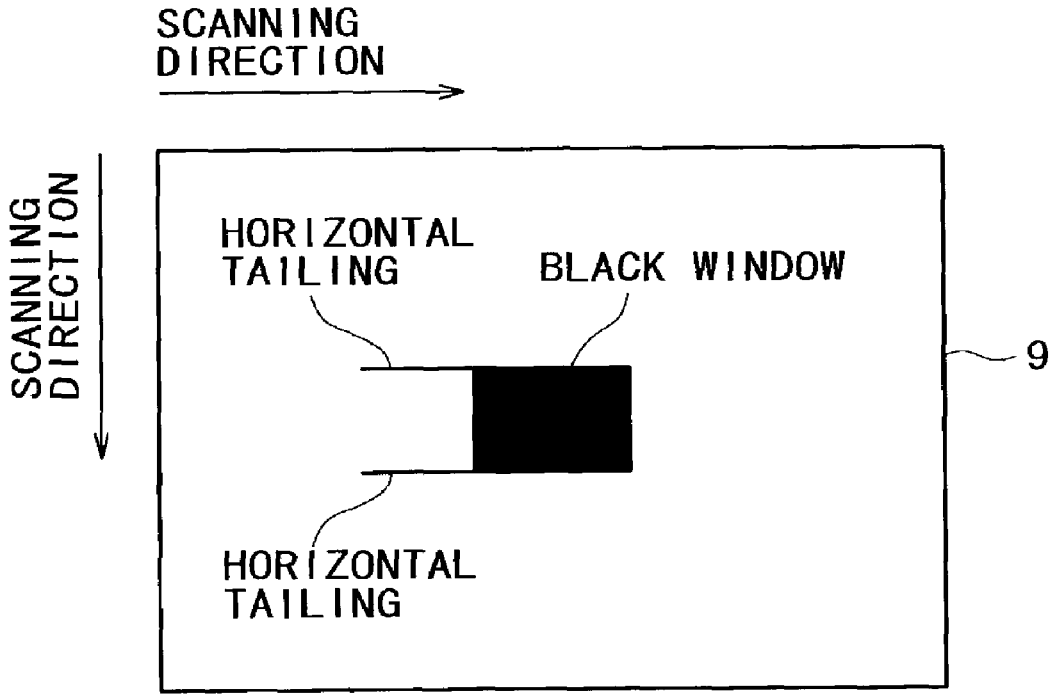
FIG. 5 is a schematic view illustrating a display defect appearing in regard to the dot line driving method illustrated in FIG. 4.

Incidentally, when an active matrix type liquid crystal display apparatus which uses the dot line inversion and the conventional 2-step dot sequential driving is used to display a black window, a black line or the like, a tailing (hereinafter referred to as horizontal tailing) which is a display of a black line appears at a location adjacent a boundary of the display of the black window or the like, that is, at a portion across which a great difference in density appears, preceding in the horizontal scanning direction as seen in FIG. 5. Appearance of such a horizontal tailing as just described deteriorates the picture quality. In the following, a cause of appearance of a horizontal tailing is described briefly. In the dot line inversion driving, the polarity of the video signal inputted exhibits an inversion between the positive and the negative with respect to the counter-potential VCOM applied commonly to the pixels for each of the pixels of the odd-numbered columns and the even-numbered columns and is further inverted for each 1H. The polarities of the pixel potentials are such as illustrated in FIG. 4. In FIG. 4, using the counter-potential VCOM as a reference, a pixel potential higher than the counter-potential VCOM is denoted by H while another pixel potential lower than the counter-potential VCOM is denoted by L.

Figure 6:
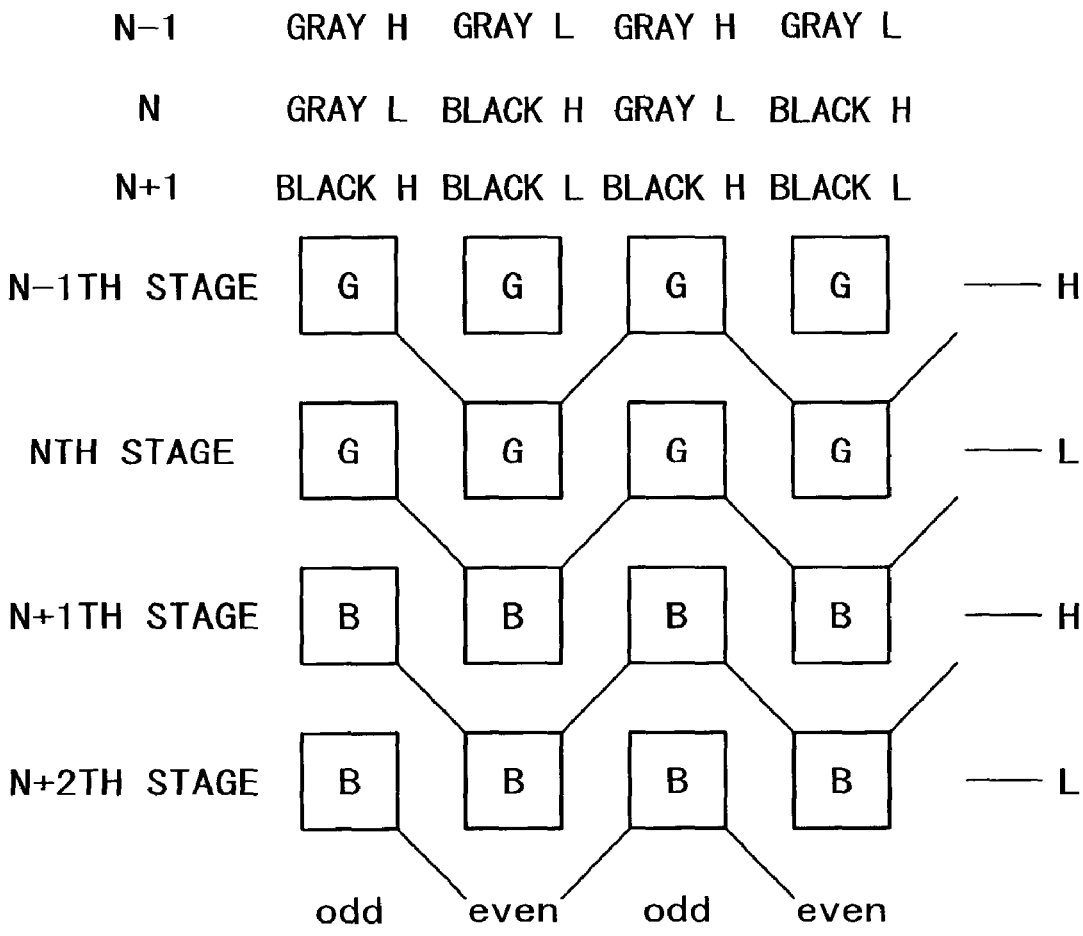
FIG. 6 is a schematic view illustrating a distribution of pixel potentials in the dot line driving method of FIG. 4.

Thus, when a black window, a black line or the like is to be displayed, such pixel potentials as seen in FIG. 6 are inputted around a boundary portion of the display of the black window or the like. In FIG. 6, G represents the gray level, and B represents the black level.

Figure 7:
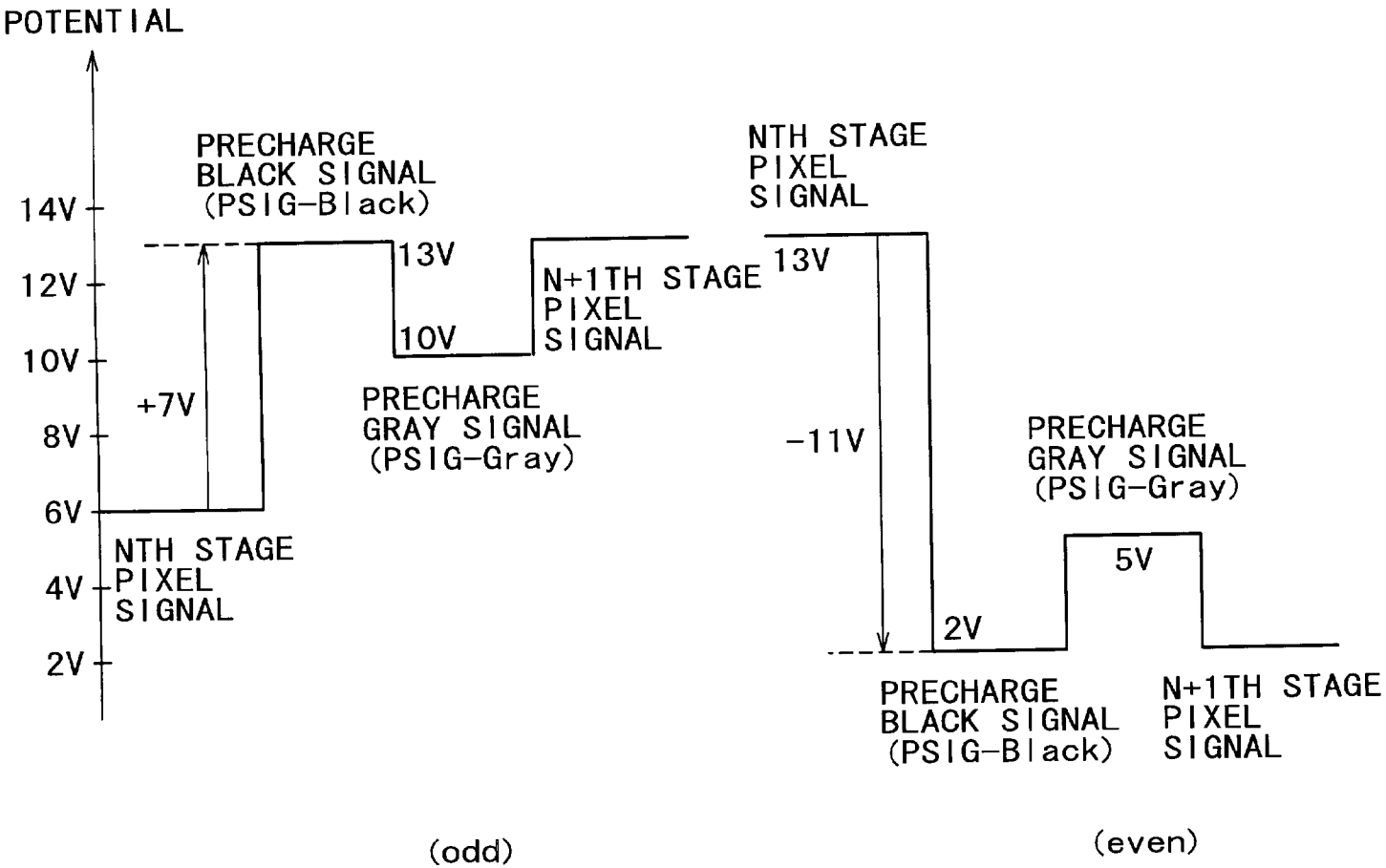
FIG. 7 is a diagrammatic view illustrating 2-step dot sequential precharge driving.

FIG. 7 shows a potential variation of a signal line where the 2-step dot sequential precharge driving is taken into consideration. Here, as an example, the H level of the precharge gray signal is set to 10 V and the L level is set to 5 V, and the H level of the precharge black signal is set to 13 V and the L level is set to 2 V. It is to be noted that, in the ordinary video signal, the H level of the gray signal is set to 9 V and the L level is set to 6 V, and the H level of the black signal is set to 13 V and the L level is set to 2 V.

As can be seen apparently from FIG. 7, the potential of the signal line varies, in each odd-numbered column, like the gray L of the Nth stage pixel potential →precharge black H→precharge gray H→black H of the N+1th stage pixel potential. On the other hand, in each even-numbered row, the potential of the signal line varies like the black H of the Nth stage pixel potential →precharge black L→precharge gray L→black L of the N+1th stage pixel potential.

In this instance, the potential variation from the Nth state pixel potential to the precharge black signal level is +7 V on the odd-numbered column side and −11 V on the even-numbered column side, and therefore, they do not cancel each other. Such a horizontal trailing as described above is caused by the potential difference between the odd-numbered column side and the even-numbered column side. Generally, a potential variation of a signal line is coupled through parasitic capacitance to a gate line to which the gate electrodes of pixel transistors are connected in a unit of a row or a common line through which the counter-potential VCOM is supplied to the pixels.

In particular, when a black window, a black line or the like is displayed with such pixel potentials as illustrated in FIG. 6, the coupling cannot be canceled between an odd-numbered column and an even-numbered column, and from this reason, a fluctuation is applied to a gate line and the common line. Since this fluctuation is mixed into a video signal when the video signal is written into another pixel similarly as in the window band, a horizontal tailing of the window appears.

Figure 8:
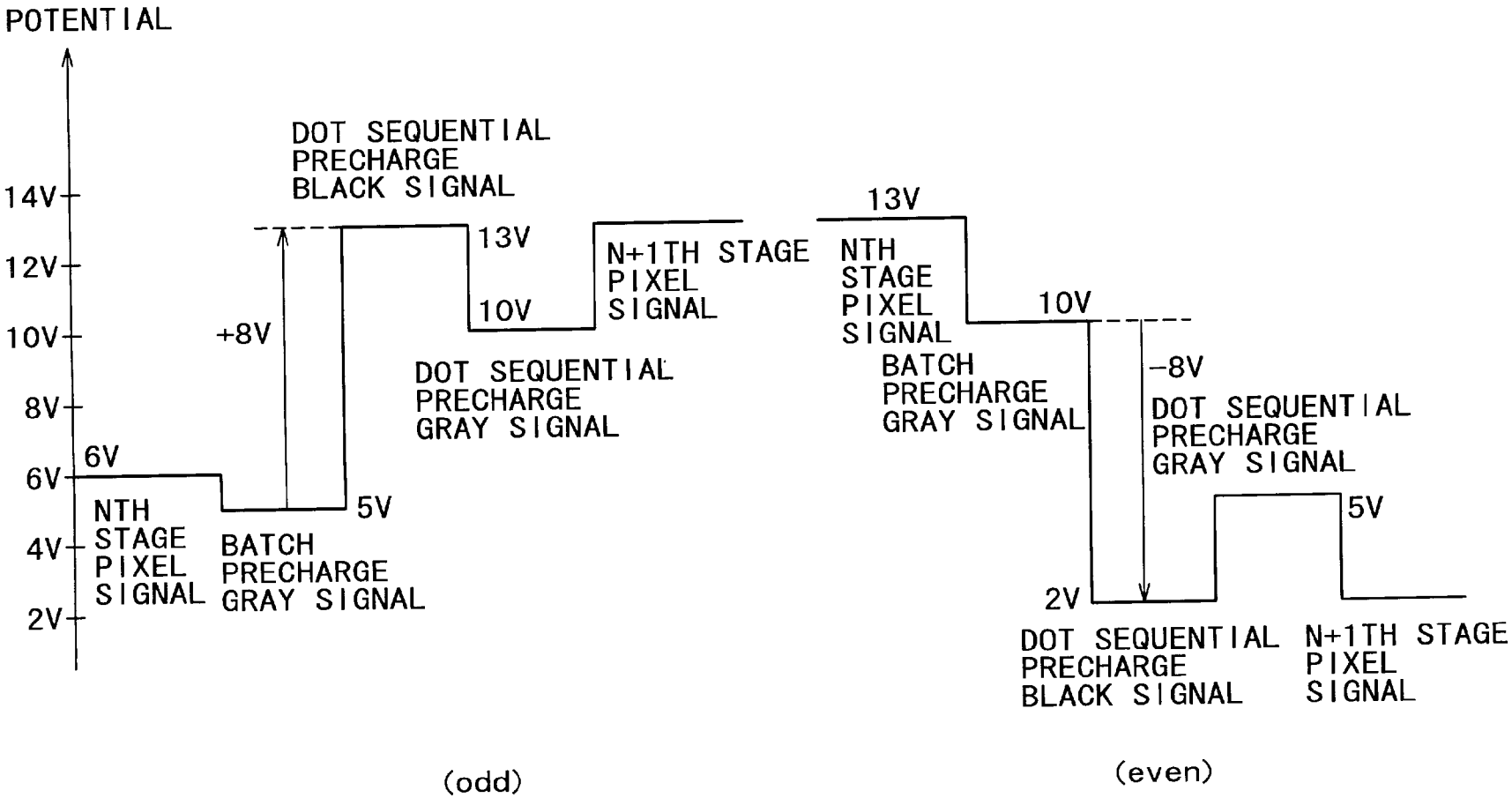
FIG. 8 is a similar view but illustrating batch+2-step dot sequential precharge driving.
Figure 10:
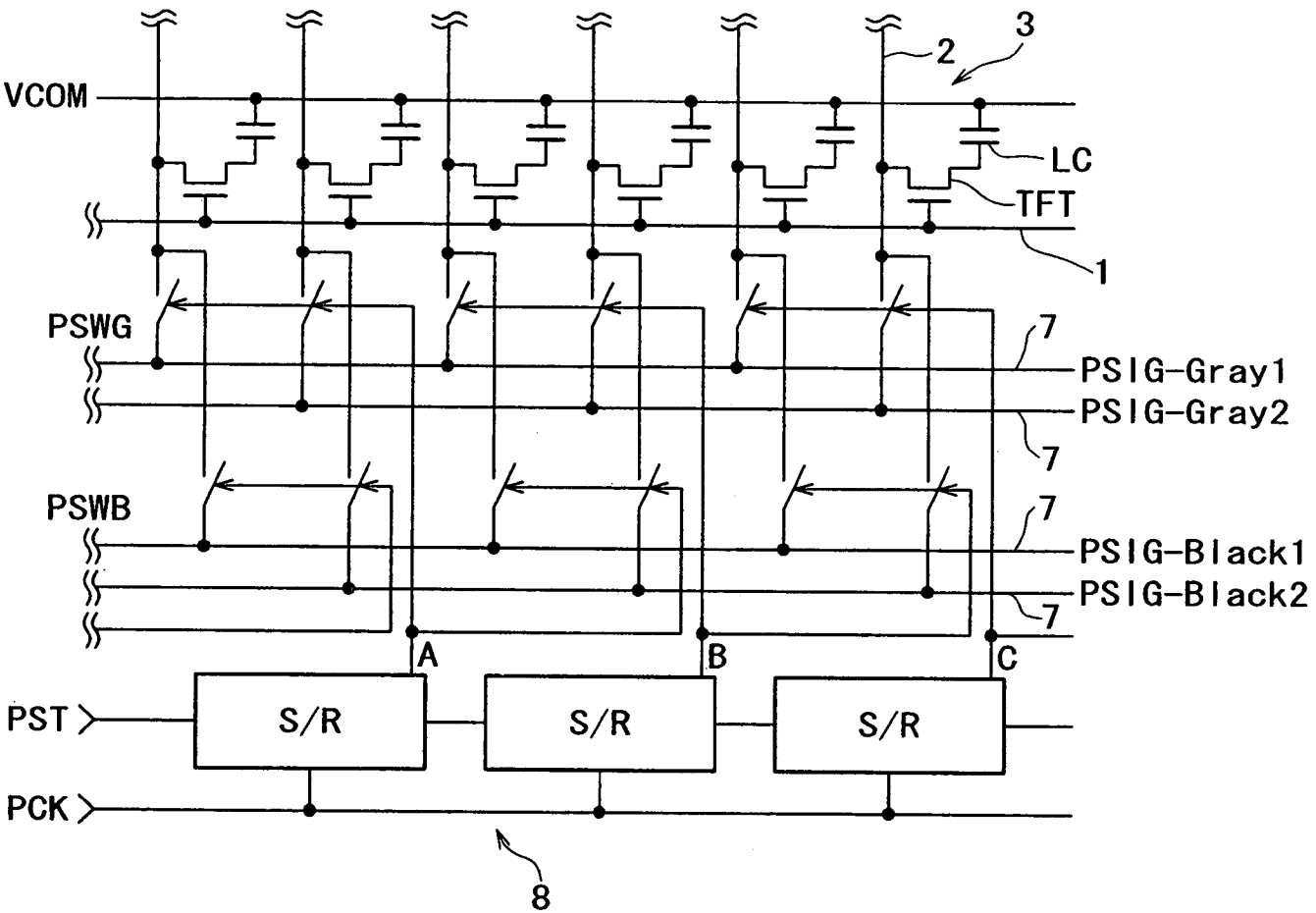
FIG. 10 PRIOR ART
FIG. 10 is a circuit diagram showing an example of a conventional precharge circuit.
Figure 11:
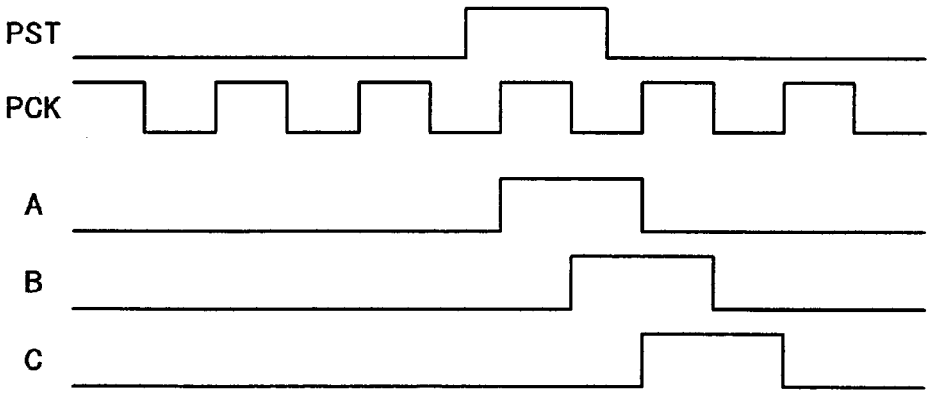
FIG. 11 PRIOR ART
FIG. 11 is a timing chart illustrating operation of a precharge drive circuit shown in FIG. 10.
Figure 12:
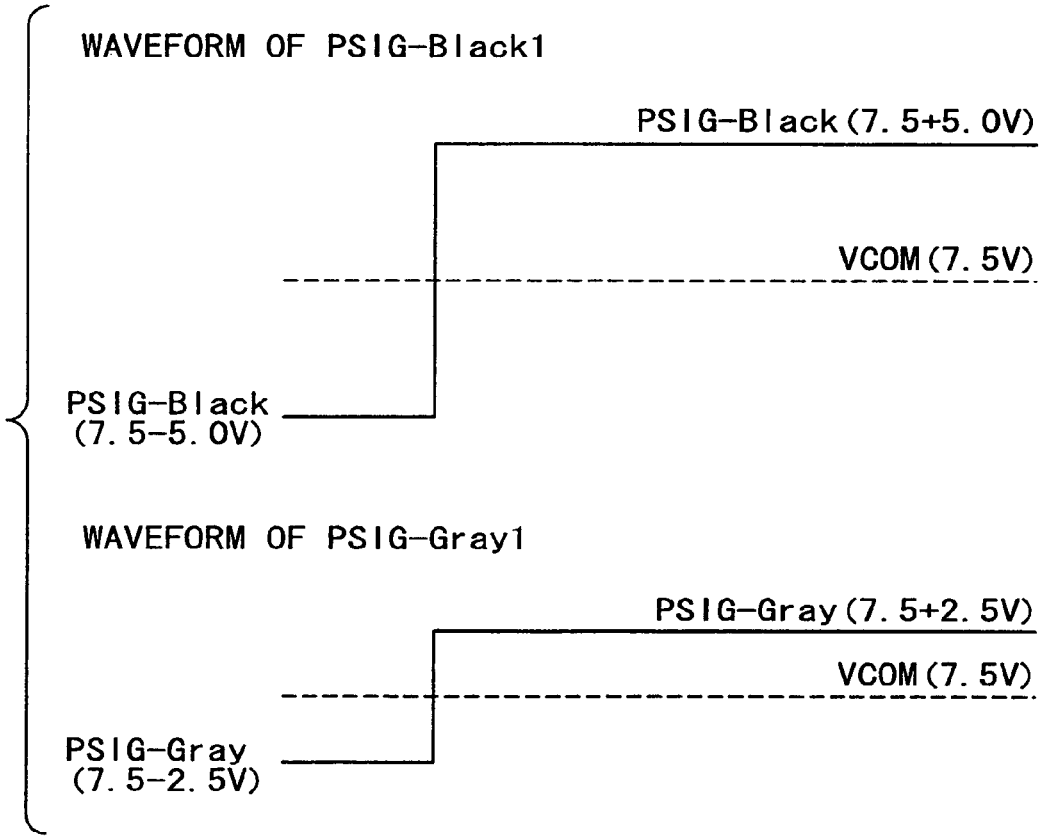
FIG. 12 is a waveform diagram illustrating operation of the precharge drive circuit shown in FIG. 10.
Figure 13:
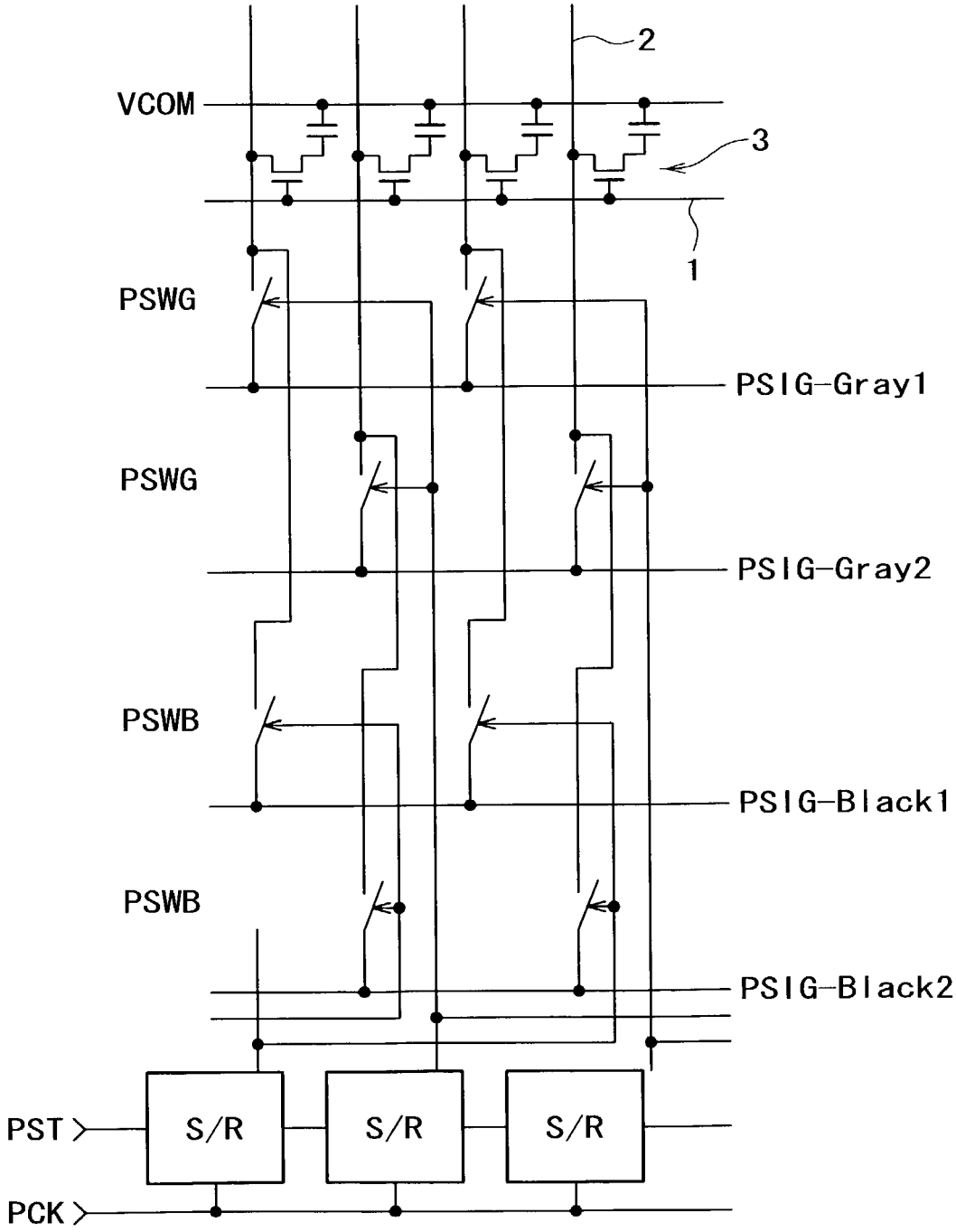
FIG. 13 is a circuit diagram showing another example of a precharge drive circuit.

To prevent such a "horizontal tailing" in the dot line inversion driving as just described, it is effective to perform such batch precharge as illustrated in FIG. 8. Referring to FIG. 8, in the batch precharge illustrated, a precharge signal of a gray level is applied in prior to the 2-step dot sequential precharge. As described hereinabove, in the dot sequential precharge of the first step, a black signal is written to suppress "vertical crosstalk", and in the dot sequential precharge of the second step, a gray signal is written as a countermeasure against a "vertical stripe". As an example, the H level of the dot sequential precharge gray signal is set to 10 V and the L level is set to 5 V, and the H level of the dot sequential precharge black signal is set to 13 V and the L level is set to 2 V. Further, the H level of the batch precharge gray signal is set to 10 V and the L level is set to 5 V. It is to be noted that, in the ordinary video signal, the H level of the gray signal is 9 V and the L level is 6 V, and the H level of the black signal is 13 V and the L level is 2 V.

As can be seen apparently also from the potential variation of a signal line illustrated in FIG. 8, by writing precharge gray signals of fixed levels (in the present example, the H level is 10 V and the L level is 5 V) into the signal lines by batch precharge within a horizontal blanking period within which no video signal is written into the pixels, the potential amplitude of each signal line with respect to the counter-potential VCOM can be made equal between an odd-numbered column and an even-numbered column.

As a result, the potential difference of a signal line when the dot sequential precharge black signal is written later becomes +8 V in each odd-numbered column and −8 V in each even-numbered column, and the absolute values of the potentials are equal to each other. Therefore, coupling from each signal line to the common line or the gate lines can be canceled fully. As a result, since a fluctuation is not mixed into any of the common line and the gate lines, a horizontal tailing which originates from such fluctuation does not appear at all. It is to be noted that, while, in the example of FIG. 8, a precharge gray signal (5 V) having a polarity same as that of the preceding stage pixel potential is used as the precharge signal for batch precharge, the precharge gray signal may have any level, and besides the precharge signal need not necessarily have a polarity same as that of the preceding stage pixel potential. However, since the batch precharge is performed within a very short period within a horizontal blanking period, the precharge signal preferably has a polarity same as that of the preceding stage pixel potential to allow writing of a dot sequential precharge black signal, which is executed immediately after the batch precharge, to be performed with certainty.

Incidentally, in the present embodiment, the batch/sequential precharge drive is adopted, and in place of the conventional method wherein a precharge signal of a black level is written dot-sequentially, a precharge signal of a black level is written in a batch and writing of a dot sequential precharge signal is performed only with a gray level. This method can be applied also to the dot line inversion driving described above. In particular, in the conventional dot line inversion driving, to remove a "horizontal tailing" unique to the driving method, batch precharge of a gray level is performed within a horizontal blanking period, and thereafter, 2-step dot sequential precharge driving is performed. This is illustrated in FIG. 8 as described hereinabove. In the batch precharge, a precharge signal of the gray level is written into all signal lines. In the present invention, both of the problems of a "horizontal tailing" and "vertical crosstalk" can be solved by changing the batch precharge signal into a black signal. Consequently, even in the dot line inversion driving, the batch+1-step dot sequential precharge driving can be performed, and a layout of a precharge drive circuit suitable for a small pixel pitch can be achieved.

While a preferred embodiment of the present invention has been described using specific terms, such description is for illustrative purposes only, and it is to be understood that changes and variations may be made without departing from the spirit or scope of the following claims.

What is claimed is:

1. A display apparatus, comprising:

a pixel array section including a plurality of gate lines extending in a direction of a row, a plurality of signal lines extending in a direction of a column, and a plurality of pixels arranged in rows and columns at points at which said gate lines and said signal lines intersect with each other;

a vertical drive circuit connected to said gate lines for successively selecting said pixels for each row within a predetermined vertical scanning period;

a video line for supplying a video signal;

a sampling switch connected between said video line and each of said signal lines;

a horizontal drive circuit for successively driving the sampling switches within a predetermined horizontal scanning period to write the video signal dot-sequentially into the pixels of the selected row;

a precharge line for supplying a precharge signal;

a precharge switch connected between said precharge line and each of said signal lines; and a precharge drive circuit for performing batch precharge wherein said precharge drive circuit drives the precharge switches at a time within a horizontal blanking period preceding to the horizontal scanning period to apply a precharge signal of a first level at a time to said signal lines and sequential precharge wherein said precharge drive circuit successively drives the precharge switches within the horizontal scanning period to successively apply a precharge signal of a second level to said signal lines.

2. A display apparatus according to claim 1, wherein said precharge drive circuit applies, in the batch precharge, a preharge signal having a polarity same as that of the video signal written in the pixels in the preceding row.

3. A display apparatus according to claim 1, wherein said gate lines of said pixel array section are wired in a unit of two rows spaced by a distance corresponding to an odd number of rows between adjacent ones of the pixel columns, and said horizontal drive circuit successively writes, into each two pixels which are connected to the same gate line and positioned adjacent each other, video signals of the opposite polarities through each of said signal lines whereas said precharge drive circuit performs the batch precharge prior to the writing of the video signals.

4. A display apparatus according to claim 1, wherein said horizontal drive circuit writes a video signal, which has a polarity which is inverted after each horizontal scanning period, into each of said pixels.

* * * * *